US005595233A

United States Patent [19]

Gower

[11] Patent Number: 5,595,233

[45] Date of Patent: Jan. 21, 1997

[54] HURRICANE SHUTTERS

[76] Inventor: Teddy A. Gower, 624 Riverside Rd., North Palm Beach, Fla. 33408

[21] Appl. No.: 369,061

[22] Filed: Jan. 5, 1995

[51] Int. Cl.[6] ..... E06B 9/00

[52] U.S. Cl. ..... 160/232; 160/352; 160/183; 52/202

[58] Field of Search ..... 160/232, 183, 160/352, 229.1, 56, 58.1; 52/202, 223.6, 222, 291; 16/378, 379, 391

[56] References Cited

U.S. PATENT DOCUMENTS

| | | | |
|---|---|---|---|
| 2,341,023 | 2/1944 | Davis | 160/183 |
| 3,020,951 | 2/1962 | Graulich . | |
| 3,893,273 | 7/1975 | Sailor | 52/223.6 X |
| 4,333,271 | 6/1982 | DePaolo et al. | 52/202 |
| 4,424,849 | 1/1984 | Robertson | 160/330 X |
| 5,457,921 | 10/1995 | Kostrzecha | 52/202 |
| 5,472,037 | 12/1995 | Hoffman | 160/183 |

FOREIGN PATENT DOCUMENTS

| | | | |
|---|---|---|---|
| 2020243 | 11/1971 | Germany | 160/232 |

*Primary Examiner*—Blair Johnson
*Attorney, Agent, or Firm*—Norman Friedland

[57] ABSTRACT

The hurricane shutters are formed from double-skinned panels that are strengthened by including a rod extending through the end channels. The panels are mounted side by side to cover the expanse of the window or door being protected. In another embodiment a cable is attached to the ends of the rod and tightened to bow the rod and panels. The ends of the panels on the extremity are left unbowed if air flow through the space between the window and panels is not desired. In other embodiments the ends of the panel are constructed to form a hinge to receive the rod which then acts as a hinge and the structural enhancement member and may extend beyond the end of the panel and serve as an attachment in a retracting and deployment mechanism.

6 Claims, 6 Drawing Sheets

HURRICANE SHUTTERS

TECHNICAL FIELD

This invention relates to window coverings for commercial and residential buildings intended as a protection against strong winds and foreign object impact occasioned by hurricanes and typhoons and particularly to the construction thereof.

BACKGROUND ART

As is well known certain disasters involving considerable loss to property have occurred over time from inclement weather conditions. This obviously has brought attention to the problem of protecting all types of structures from damage occasioned by such inclement weather conditions where strong winds either directly cause damage to the structures or indirectly cause damage by picking up objects of all types which effectively become missiles that impact on frangible parts of the structures. Once so damaged the structure is much more susceptible to further deterioration by the inclement weather conditions.

There have been, over the years, many attempts to protect these frangible building structures from damage. This particularly applies to weaker areas such as windows, glass doors, large garage doors, ventilation louvers and the like. One such method for this type of protection is to put protective coverings over these portions of the structures. These protective coverings are known in the art as "storm or hurricane shutters" and may range from plywood fastened to the frame of the window, door or the like with nails or screws to permanently installed motorized roll up shutters which deploy and retract at the throw of a switch. Some of these are tailored to fit and permanently installed on the frame and either fold, slide or roll over the area or back for storage. Some are tailored to fit but are stored elsewhere and put into place when inclement weather threatens.

The folding and roll type of shutters are typically of slat structure fabricated from wood, steel, aluminum, plastic or other materials or the type that consists of panels that are hinged and unfolded to overlie the window or panels that are hinged to one another and roll up. Window covers of these types are exemplified in U.S. Pat. No. 4,343,340 granted to Paule on Aug. 10, 1982 entitled "Shutter Slat Configuration" and U.S. Pat. No. 3,020,951 granted to Graulich on Feb. 13, 1962 and entitled "Storm Shutter Assembly". Aside from the desirability or non desirability of these type of shutters being decorative and being aesthetically pleasant, as is well known in the industry many of these shutters that are currently commercially available are notoriously short of meeting the structural integrity required for existing and pending bylaws and building codes in various areas. As legislation governing building standards become more stringent there should be an increasingly larger demand for storm shutters that can meet these present and future stringent standards.

The problem with the panel or boarding method as described hereinabove is that the panels or boards are typically heavy and cumbersome to install and remove. Additionally they are opaque and hence darken the interior of the building. Certain shutters have light transmitting panels and openings but these generally cause inherent weakness in the shutter thusly diminishing the possibility of meeting the stringent standards mentioned hereinabove. However, light transmission is very desirable to make the building more naturally habitable. The normal implication of this advantage is that it will allow the shutter to be put into place early upon the very first warnings of inclement weather rather than left until the last moment when other needs are also pressing. This is particularly true in multi-unit buildings that include many areas that require protection.

I have found that I can overcome the problems alluded to in the above by providing a storm shutter construction that is capable of withstanding impact and wind standards that are being implemented in many localities, and also providing storm shutters that are transparent so that the objections of darkening the building interior and the lack of capacity to look through them is obviated. In one embodiment of these storm shutters, this invention contemplates fabricating panels from commercially available double-skinned sheets (axially spaced sheets) of plastic having elongated webs defining a plurality of side-by-side open ended channels. In my coverings these channels are oriented so that they are preferably but not necessarily vertical with respect to ground. A rod made from metal, plastic or composite material is judiciously located in one or more discretely located channel(s) and are sized to extend through and in some applications beyond the channel(s). Each rod is then positively fastened to the frame of the window or door intended to be protected. In another embodiment in which a longer span is required, the rods include hooks or other fastening means for accommodating cables or straps that are tensioned to bow each rod and, in turn, bow the panel(s) to a predetermined arc to form a cambered unit. Where there are a number of adjacent panels used in a row, the end panels may be left with the outer side unbowed to prevent air flow between the panel and side portion of the frame. When unbowed the space which would otherwise exist between the frame and panel is eliminated and the panel hugs the face of the window or door frame.

In still another embodiment of this invention, the side edges of each panel include spaced interconnecting hinged joints that interlock with each other and the rod used for strengthening the panels also serves the additional function of the hinged pin so that the panels may be folded one over the other for uncovering the window or door when not in use and retained on the window or door frame. These panels or slats could also be accordioned or rolled for storage. The rod spacing and panel width would be dependent upon the span being covered. Any number of panels or slats could be connected in this manner either vertically or horizontally to either roll up or accordion together for storage.

Obviously, because the sheets are made from a plastic material they inherently provide good resistance to mildew, warping, rotting, corrosion and the like and may include protection against ultra violet rays. Protection from these occurrences are commonly included in the commercially available sheets.

Another advantage of this invention is that it easily accommodates the thermal expansion and contraction found in all plastic. Heretofore known material of this type has been utilized as a protective and insulating glazing product. This has entailed a sophisticated and complex framing system to support the panels which added substantially to the difficulty and cost of installation and afforded very little additional strength to the final installed product.

Another advantage of this invention is that the system can be aesthetically and functionally varied to meet each situation by avoiding complex and sophisticated framing and using different colors that are available in the commercial sheet goods. This provides the installer or designer flexibility and sundry choices such as sun shading, matching color schemes and the like.

SUMMARY OF THE INVENTION

An object of this invention is to provide improved hurricane shutters that are characterized as being capable of meeting predetermined impact and structural integrity requirements, are transparent, relatively light weight and easy to install. Additionally they are durable, aesthetically pleasing and have good storing qualities.

A feature of this invention is the provision of multi-channeled double-skinned sheets of known construction and orienting the sheets so that the channels are vertical with respect to ground and that structural rods are discretely and judiciously inserted in certain channel(s). One embodiment includes utilizing rods that are fabricated from spring metal stock that is resilient and bendable and applying tension to a cable attached to the ends of the rod to cause the panel to bow over the length of the channels. In embodiments utilizing several adjacent panels, the end panels may remain unbowed along the outermost side to bear against the surface of the frame portion used for attaching the panels so as to block the air from flowing through the gap formed between the window frame and panels.

Another feature of this invention is the provision of the multi-channelled double-skinned sheet where the ends of adjacent panels are preformed with spaced interlocking hinge loops and the rod serves as both the hinged pin and the structural enhancement of the covering. This permits the panels to be permanently mounted on the window frame and be folded one over the other and moved away from the window.

The foregoing and other features of the present invention will become more apparent from the following description and accompanying drawings.

DETAILED DESCRIPTION OF THE PREFERRED EMBODIMENT

Figure 1:
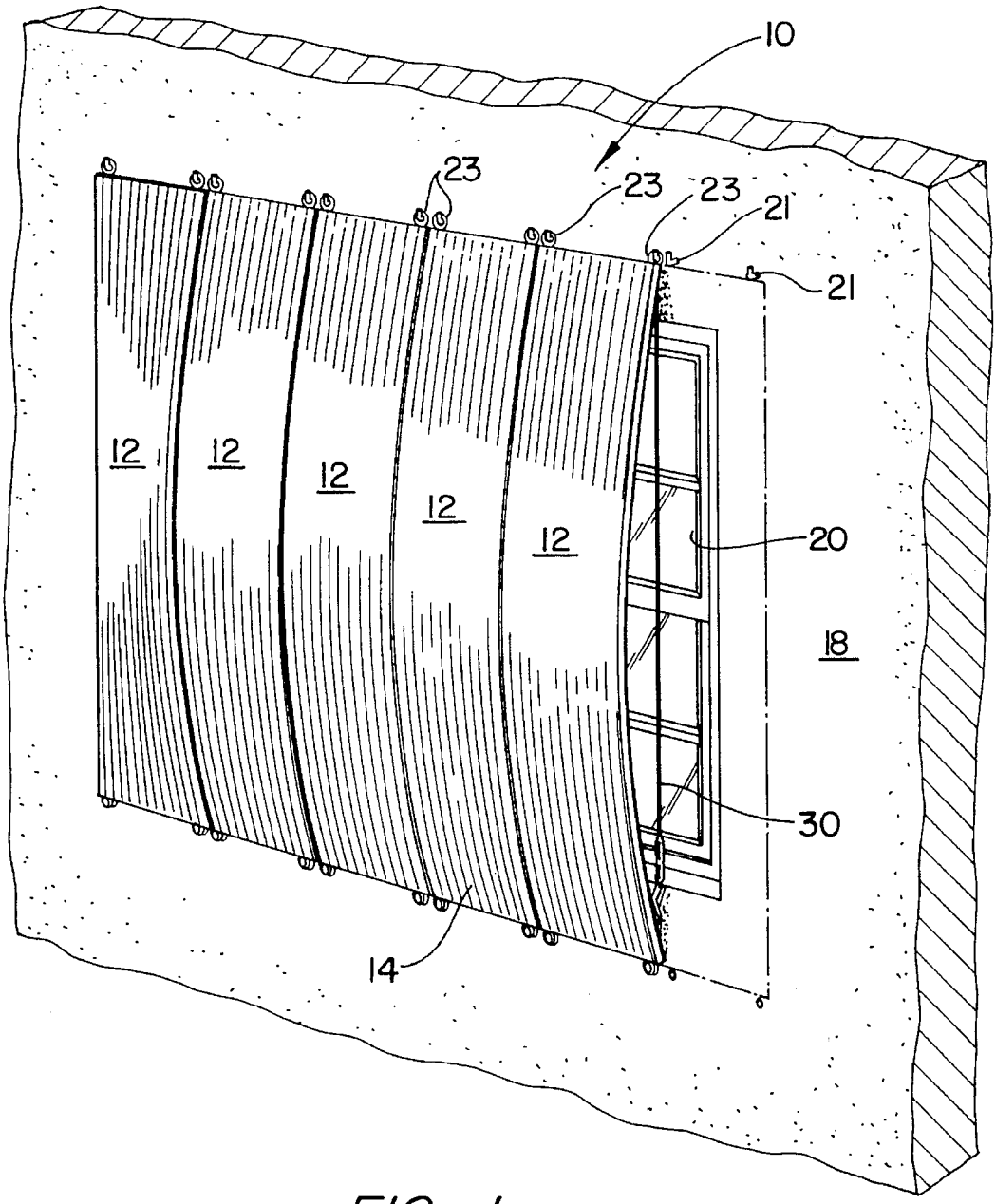
FIG. 1 is a schematic view in elevation illustrating a plurality of panels forming a window covering where the end of the left panel is left unbowed and the other panels are bowed.

This invention is directed to window and door coverings for protection against heavy winds and missile impact that fall within a certain structural standard and particularly for coverings that serve to protect against impact forces produced by missiles that are nine (9) pounds in weight and nominal 2×4 in dimension and impacting the coverings at velocities of 50 feet/second or more. These panels of this invention can be flush mounted to existing window and door frames without having to include spacers that would space the covering away from the frame as is the case of heretofore known shutters. In the context of this description and within the scope of this invention the term rod may also include other than a solid cylindrical shaped member such as an "I" beam or hollow tube and may be used independently or in conjunction with the rod.

As noted in FIGS. 1–4, the window covering generally illustrated by reference numeral 10 consists of a plurality of panels 12 mounted in side-by side relationship. Suitable panels that can be used for fabricating these coverings are double-skinned plastic sheets formed with side-by-side opened ended channels known as ACRYLITE® SDP® or the polycarbonate version known as CYROLON® SDP® and are commercially available from Cyro Canada Inc. The sheets are available in standard dimensions or may be ordered to specific specifications. The typical dimensions of the standard sheets are 16.00 millimeters (mm) thick, 1200 mm wide and 2.4, 3.0 3.6 and 4.8 meters long.

According to this invention, each panel 12 is oriented with the channels 14 depicted by the broken lines disposed vertically relative to ground. In one embodiment the panels remain flat with a rod 16, preferably made from a structural spring metal material dimensioned to fit into the channel 14 and extend therethrough disposed at the end channels of each panel. In this unbowed or flat panel embodiment (configured similar to the left end of the left panel of the covering depicted in FIG. 1) the rod 16 remains straight and omits the cable mounting illustrated in FIGS. 1–4 and is attached to the frame 18 of the window 20 as will be described hereinbelow.

While any well known fastening means may be employed, in the preferred embodiment, L-shaped screws 21 are fastened to the frame 18 of the window 20 and protrude beyond the surface of the frame 18 to accommodate the fitting formed on the end of the rod 16. If the frame is constructed from wood, the L-shaped screws 21 would take the form of wood screws and screw directly into the wood. If the frame is constructed from concrete, threaded inserts would be anchored into the concrete in a well known manner and the L-shaped screws 21 would screw into the insert.

Figure 2:
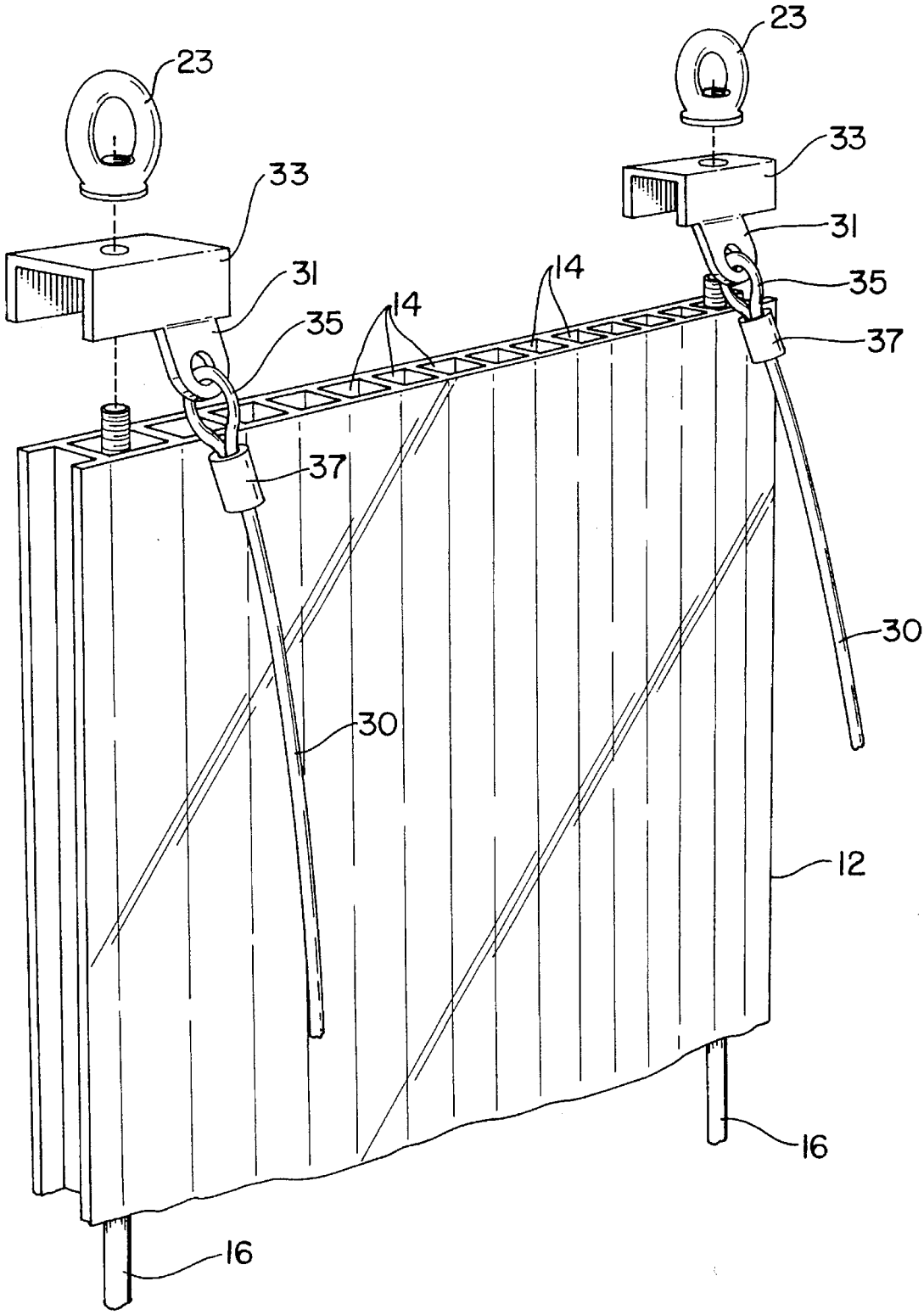
FIG. 2 is a partial exploded view in perspective illustrating the details of one embodiment of this invention.

The rod may be fabricate with an integral hook or eyelet 23 that would fit over the L-shaped hook 21 or as a separate piece that is threaded to threads formed at the end of rod 16. A suitable eyelet assembly is depicted in FIG. 2. The bottom of the rod would include an opening for accepting a threaded stud or bolt affixed to the window frame as described above. The stud or bolt would extend through the rod and aligned holes formed in the panel for accepting a winged bolt 27. Obviously, the rod must be allowed to pass through the channels so that one end of the rod must be designed to accommodate this feature.

The method of mounting the panel to the window frame as described immediately hereinabove avoids the use of tools once the hardware is installed to the frame of the window or door. Obviously, this invention contemplates that the bottom fitting can take the form of a winged bolt as described or a stud fitted into and extending from the frame and adapted to pass through the eyelet on the rod 16 can be used and a winged nut can be threaded thereto.

To install each of the panels the eyelet 23 of the rod at the top of the panel is fitted over the L-shaped fastener and the bottom is aligned to fit over the extending inserts 29 and winged bolt 27 is threadably secured to the insert 29 for holding the panels in place. Each panel is similarly installed until the entire covering is completed.

Figure 3:
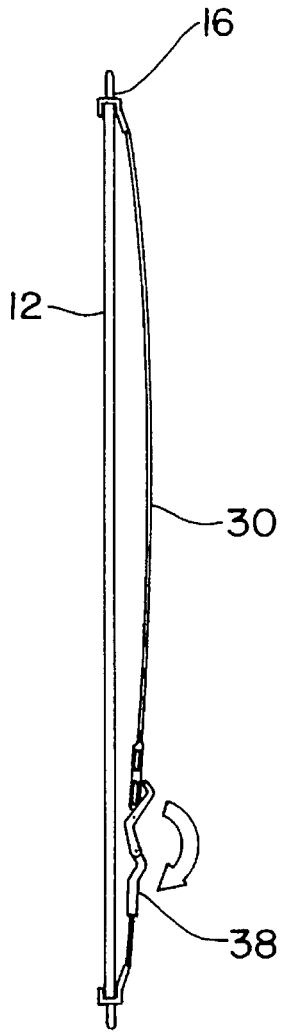
FIG. 3 is an end view of the panel illustrating the cable attachment in the retracted position.
Figure 4:
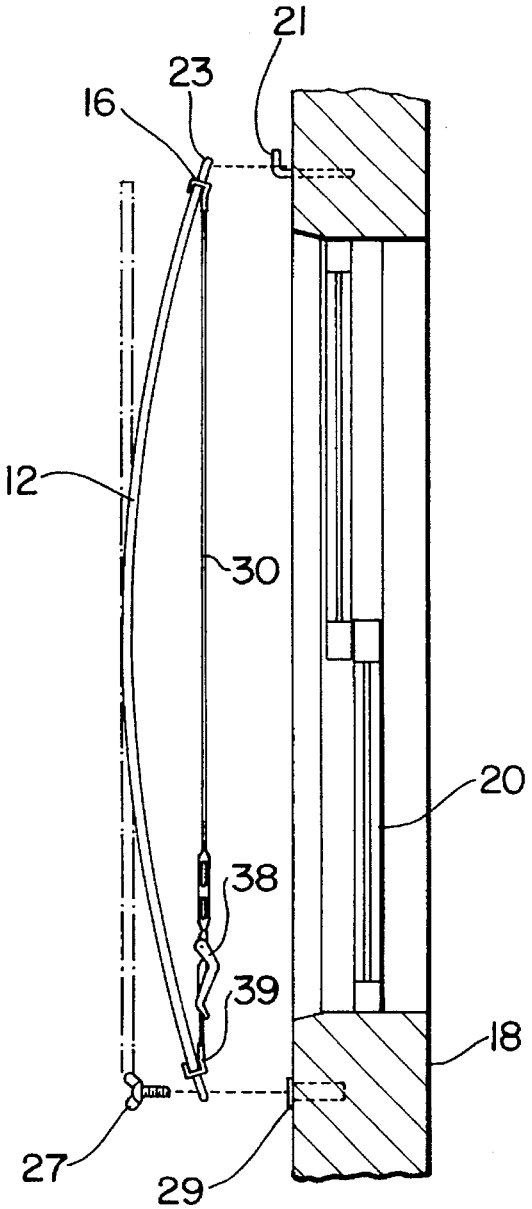
FIG. 4 is the end and exploded view of the embodiment in FIG. 3 with the panel/cable deployed and a sectional view of a window and frame illustrating the attachment of the panel to the window frame.

Another embodiment of this invention is exemplified in FIGS. 1–4 where the panels are bowed in order to enhance the integrity of the panel. Each of the panels would include a rod that is adapted to be tensioned by a cable or strap. The end of cable 30 is inserted into eyelet 31 of cap 33 bent to form a loop 35 and supported by swage fitting 35 so as to be attached to the top of rod 16. An identical cap 39 is attached to the bottom of rod 16 and the cable is similarly looped. The cable 30 is tightened to a predetermined tension to bend the rod 16 and hence, panel 12 to bow in the vertical direction with respect to ground. Except for the bowing and the elements to bow the panels, the panels depicted in FIGS. 1–4 are constructed identical. While the above describes one method of attaching the cable 30 to rod 16 the cable 30 may be affixed to the rod 16 in any well known manner. As for example, inserting the cable through an eyelet directly formed at the end of rod 16 and bending it in situ to form hook 35 held by the swaged member 37 is another method of attaching the cable. The opposite end of cable 30 may be likewise attached to the bottom of rod 16. A hinged latch 38 is inserted in the cable 30 so that in the opened or retracted position as shown in FIG. 3 the tension is removed and the rod and hence panel will assume a flat position. By closing the hinged latch 38, the cable 30 becomes taut and the tension causes the rod 16 and panel 12 to bow as shown in FIG. 4.

Attachment to the window frame is identical to the method described above where the eyelets 23 of rod 16 are fitted on the L-shaped hooks 21 extending from the window frame 18 of window 20 and the bottom of the rod 16 is fastened by the wing bolts 27 that attach to the inserts 29 which in turn is mounted in the frame 18.

Figure 5:
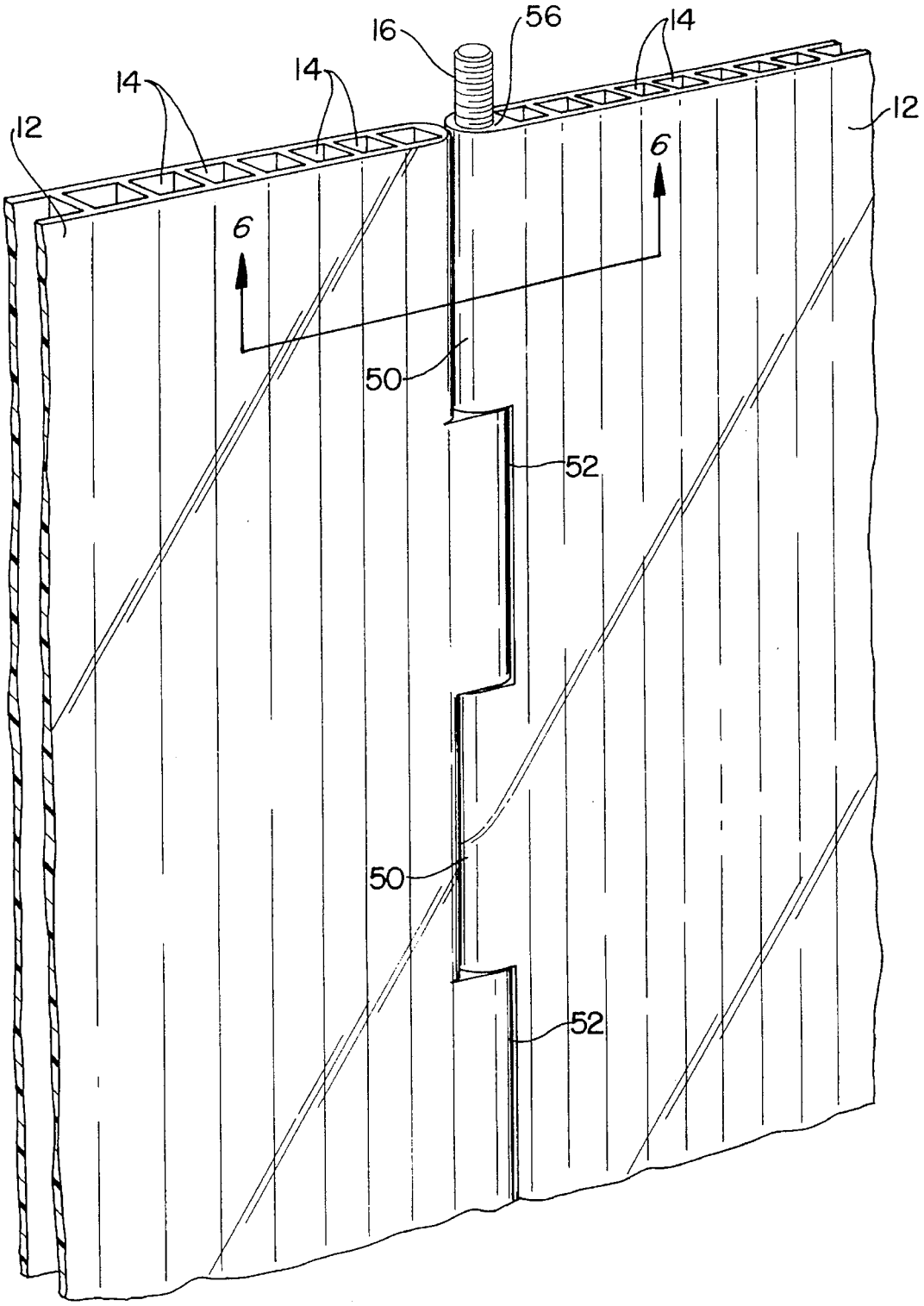
FIG. 5 is a view in perspective illustrating another embodiment of this invention.
Figure 6:
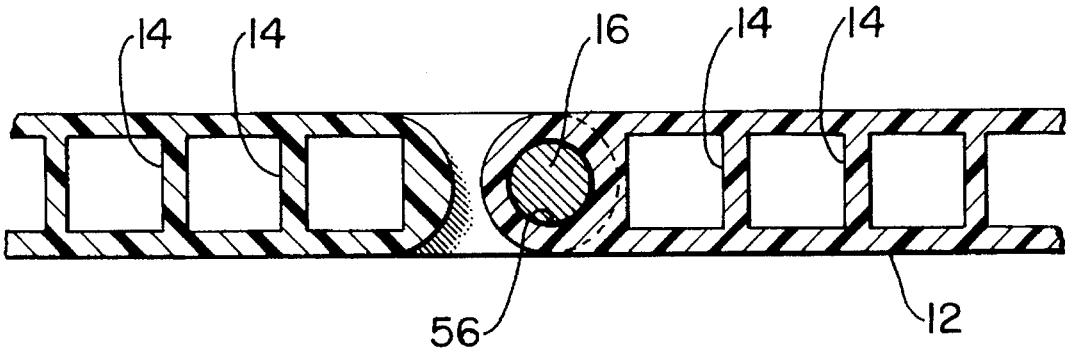
FIG. 6 is a partial view in section taken along lines 6–6 of FIG. 5.
Figure 7:
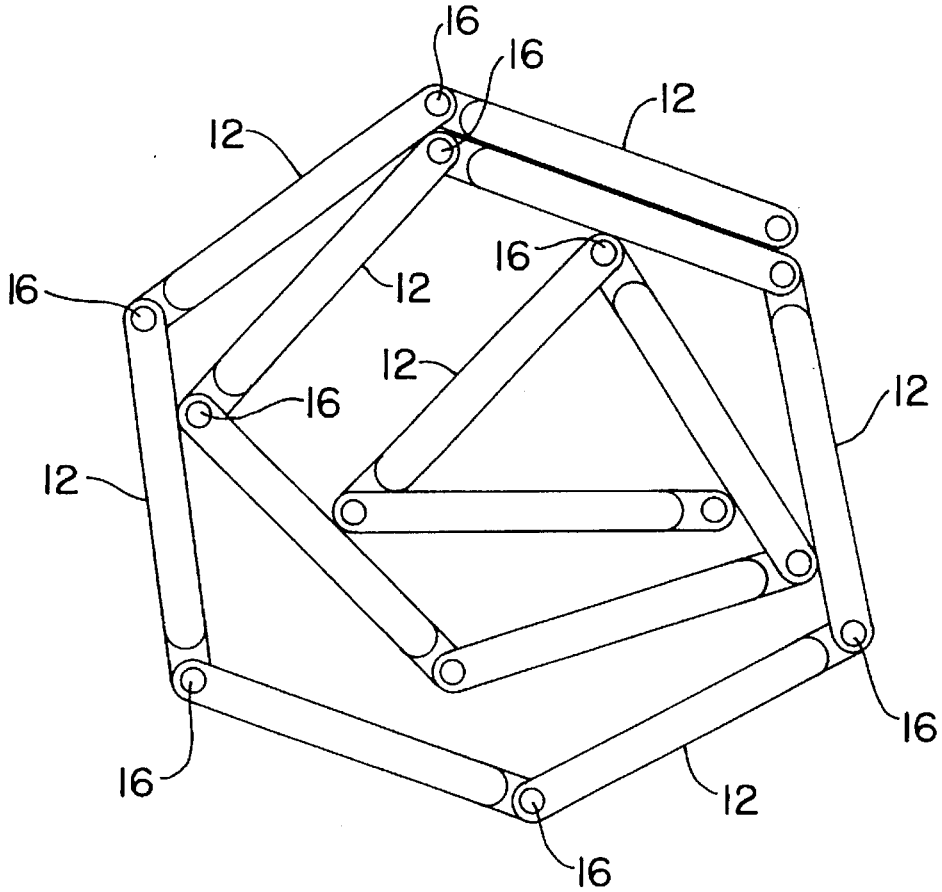
FIG. 7 is a schematic view illustrating the inventive shutters in the process of being retracted.

FIG. 5 exemplifies another embodiment of this invention where the double-skinned panels are formed so as to be rolled when retracted and deployed. The panels are constructed identical to the panels in FIGS. 1–4 except the ends are specifically constructed to accept a hinge pin and rotate relative to each other. The same reference numerals depict the same elements in all the Figures. The double-skinned panels 12 include a curved end portion 50 that is spaced along the mating edge 52 to accommodate a complementary curved end portion 54, likewise spaced. The complementary curved end portions 50 and 54 project axially into the recesses formed at the ends thereof and interlock much like a piano hinge and the rod 16 is inserted in the aperture or channel 56 to pass through complementary apertures 56 in the curved end portions 50 and 54. It is apparent from the foregoing that the rod 16 serves both as the hinge and the enhancement of the structural integrity of the shutter. FIG. 7 demonstrates the panels in a partially rolled position when they are being retracted for storage purposes. In this embodiment the channels are preferably oriented in the horizontal position. The rod 16 may extend beyond the end of the panel and serve as a guide in a retraction and deployment mechanism (not shown).

Figure 8:
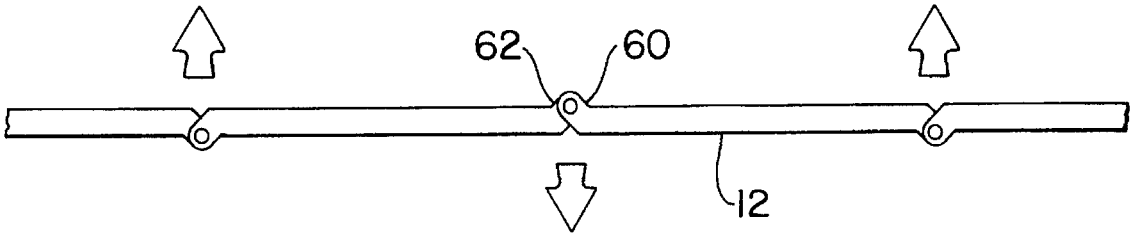
FIG. 8 is a schematic view illustrating another embodiment of this invention with foldable shutters being deployed.
Figure 9:
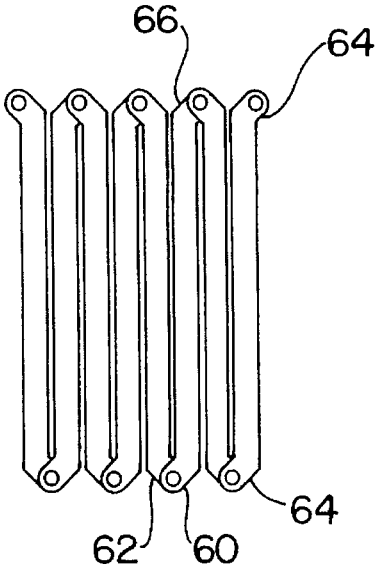
FIG. 9 is a schematic view illustrating the shutters in FIG. 8 in the retractable position.

FIGS. 8 and 9 illustrate still another embodiment of this invention where the ends of the panels are similarly formed in a hinged construction where the ends 60 and 62 of panels 12 are angularly bent outwardly and include the mating complementary end portions 64 and 66 similarly configured as that illustrated by the end portions 50 and 52 depicted in FIG. 5. The rod 16 that serves as the hinge pin also serves to enhance the structural integrity of the panels to withstand the heavy winds and object impact described hereinabove.

Although this invention has been shown and described with respect to detailed embodiments thereof, it will be appreciated and understood by those skilled in the art that various changes in form and detail thereof may be made without departing from the spirit and scope of the claimed invention.

I claim:

1. A storm shutter having at least one double-skinned panel, said double-skinned panel having a plurality of web members extending between the double-skin of said double-skinned panels defining a plurality of side by side open ended channels, a removable rod extending through at least one of said open ended channels, said rod including means for attaching said panels to the frame of the window or door intended to be protected, said rod includes a threaded end portion and an eyelet threadably mounted on said threaded end portion, a cable attached to one end of said rod and to the other end of said rod and means for adding tension to said cable to bow said rod and said double-skinned panel.

2. A storm shutter as claimed in claim 1 including a latch attached to said cable for imparting tension to said cable.

3. A storm shutter as claimed in claim 2 including a plurality of double-skinned panels mounted side by side, a rod extending through each of end channels of said plurality of channels, said cables attached to each rod whereby each panel is bowed by applying tension to each of said cables.

4. A storm shutter as claimed in claim 3 where the rod inserted in each of channels of said plurality of channels in the end of the channels of the extremity mounted double-skinned panels are without a cable and left unbowed whereby the air flow through the gap between said double-skinned panel and the window or door is thwarted.

5. A storm shutter having a plurality of double-skinned panels, each of said double-skinned panels having a plurality of web members extending between the double-skin of said double-skinned panels defining a plurality of side by side open ended channels, a removable rod, means attached to said rod to exert a bend thereto for enhancing the strength of said panel, spaced lateral recesses formed at the outer channels of the adjacent panels to define alternate spaced projections at adjoining edges of adjacent panels of said plurality of double skin panels defining interlocking spaced hinge portions where the projections of one of the adjacent panel fits into one of the recesses of the other adjacent panel , said removable rod extending through said outer channels formed in said spaced projections defining a hinge connection between adjacent panels and said rod defining a hinge pin and enhancing the structural integrity of said double-skinned panel whereby said double-skinned panels are rolled and unrolled to be placed in the retracted and deployed positions.

6. A storm shutter as claimed in claim 5 wherein said spaced projections formed at the end of each of said adjacent double-skinned panels extend angularly outward relative to said double-skinned panels and said rod extending through said means to define the hinge pin and to enhance the structural integrity of each of said double skinned panels whereby each of said plurality of double-skinned panels are folded one over the other to be retracted and unfolded to be deployed to cover the window or door.

* * * * *